US010730298B2

(12) United States Patent
Ishida

(10) Patent No.: US 10,730,298 B2
(45) Date of Patent: Aug. 4, 2020

(54) LIQUID DISCHARGING APPARATUS, MANUFACTURING METHOD OF LIQUID DISCHARGING APPARATUS, AND MAINTENANCE METHOD OF LIQUID DISCHARGING APPARATUS

(71) Applicant: SEIKO EPSON CORPORATION, Tokyo (JP)

(72) Inventor: Yukimasa Ishida, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 16/155,757

(22) Filed: Oct. 9, 2018

(65) Prior Publication Data

US 2019/0105901 A1 Apr. 11, 2019

(30) Foreign Application Priority Data

Oct. 11, 2017 (JP) ..... 2017-197395

(51) Int. Cl.

| | |
|---|---|
| ***B41J 2/175*** | (2006.01) |
| ***B41J 2/15*** | (2006.01) |
| ***B41J 2/14*** | (2006.01) |
| ***B41J 2/155*** | (2006.01) |

(52) U.S. Cl.

CPC ..... *B41J 2/155* (2013.01); *B41J 2/14274* (2013.01); *B41J 2/175* (2013.01); *B41J 2/17596* (2013.01); *B41J 2002/14491* (2013.01)

(58) Field of Classification Search

CPC ..... B41J 2/155; B41J 2/14274; B41J 2/175; B41J 2/17596

See application file for complete search history.

(56) References Cited

U.S. PATENT DOCUMENTS

| | | | | |
|---|---|---|---|---|
| 2003/0146958 | A1 | 8/2003 | Aruga et al. | |
| 2004/0003738 | A1* | 1/2004 | Imiolek | B22F 3/1055 101/480 |
| 2005/0073559 | A1* | 4/2005 | Aruga | B41J 2/17509 347/85 |
| 2008/0165224 | A1 | 7/2008 | Akahane | |
| 2010/0220152 | A1 | 9/2010 | Hayashi | |
| 2016/0023464 | A1 | 1/2016 | Nakao et al. | |

(Continued)

FOREIGN PATENT DOCUMENTS

| | | | |
|---|---|---|---|
| JP | 2004-142405 | A | 5/2004 |
| JP | 2008-100400 | A | 5/2008 |

(Continued)

*Primary Examiner* — Jason S Uhlenhake
(74) *Attorney, Agent, or Firm* — Workman Nydegger

(57) ABSTRACT

A liquid discharging apparatus is provided with a first recording head including a first nozzle, a second recording head including a second nozzle, a first valve provided with a first valve body configured to open and close according to a pressure on the first recording head side, and a second valve provided with a second valve body configured to open and close according to a pressure on the second recording head side. The first and second valves have different openabilities, and a difference between dischargeabilities of a liquid from the first nozzle and dischargeabilities of a liquid from the second nozzle is smaller than the difference in a case in which the second valve is connected to the first recording head via the first flow path and the first valve is connected to the second recording head via the second flow path.

10 Claims, 9 Drawing Sheets

(56) References Cited

U.S. PATENT DOCUMENTS

| | | | |
|---|---|---|---|
| 2016/0279936 | A1 | 9/2016 | Yamamoto et al. |
| 2017/0217198 | A1 | 8/2017 | Sato et al. |

FOREIGN PATENT DOCUMENTS

| | | | |
|---|---|---|---|
| JP | 2010-201730 | A | 9/2010 |
| JP | 2013-139143 | A | 7/2013 |
| JP | 2016-22704 | A | 2/2016 |
| JP | 2016-179599 | A | 10/2016 |
| JP | 2017-136823 | A | 8/2017 |

* cited by examiner

| | EASILY OPENABLE VALVE | NOT EASILY OPENABLE VALVE |
|---|---|---|
| | OPERATE AT SMALL NEGATIVE PRESSURE | OPERATE AT GREAT NEGATIVE PRESSURE |
| SPRING FORCE Fsp | SMALL | LARGE |
| FILM REPULSIVE FORCE Ffm | SMALL | GREAT |
| VALVE SHAFT LENGTH L | LONG | SHORT |
| SHIELD DIAMETER D | SMALL (NARROW) | LARGE (WIDE) |

FIG. 10

| | EASILY OPENABLE VALVE | NOT EASILY OPENABLE VALVE |
|---|---|---|
| | OPERATE AT SMALL NEGATIVE PRESSURE | OPERATE AT GREAT NEGATIVE PRESSURE |
| WATER HEAD Ph | SMALL | LARGE |
| PRESSURE LOSS Pl | GREAT | SMALL |
| RESISTANCE FACTOR 1 | | |
| · LIQUID VISCOSITY | HIGH | LOW |
| · LIQUID TEMPERATURE | LOW TEMPERATURE | HIGH TEMPERATURE |
| RESISTANCE FACTOR 2 | | |
| · FLOW PATH LENGTH | LONG | SHORT |
| · FLOW PATH SECTIONAL AREA | SMALL | LARGE |
| · FLOW PATH INNER SURFACE ROUGHNESS | HIGH (ROUGH) | LOW (SMOOTH) |
| FLOW RATE FACTOR | | |
| · LIQUID FLOW RATE | HIGH | LOW |

LIQUID DISCHARGING APPARATUS, MANUFACTURING METHOD OF LIQUID DISCHARGING APPARATUS, AND MAINTENANCE METHOD OF LIQUID DISCHARGING APPARATUS

BACKGROUND

1. Technical Field

The present invention relates to a liquid discharging apparatus.

2. Related Art

A liquid discharging apparatus such as a printer is provided with a recording head for discharging a liquid onto a recording medium or the like. JP-A-2008-100400 discloses a printer in which a recording head is provided with an ink pressure adjustment unit. The ink pressure adjustment unit has a function of opening and closing a valve according to pressure fluctuation in an inner portion of the ink pressure adjustment unit and controls the supply of a liquid to the recording head. Hereinafter, the ink pressure adjustment unit will be referred to as a valve.

In the valve, there is a case in which the ease of opening a valve in the inner portion of the valve is different for each individual valve due to manufacturing error and the like. Therefore, for example, in a case in which a plurality of recording heads are lined up to configure a line head and an individual valve is connected to each of the recording heads, there is a possibility that density irregularities will occur on the recording medium due to differences in the ease of opening the valves in the inner portion of each of the valves. Meanwhile, in the line head which is configured by a plurality of recording heads, there is a case in which characteristics such as the water head of the liquid which is supplied, the flow path resistance of the inner portion of the valve, the flow rates of the liquid to be discharged are different for each of the recording heads, and accordingly, the discharging characteristics of the liquid fluctuate for every recording head and there is a possibility that density irregularities will occur. Therefore, there is a demand for a technique capable of suppressing an increase in the degree of density irregularities caused by variation in the ease of opening in the valves and variation in the characteristics of the recording heads in the liquid discharging apparatus which is provided with a plurality of recording heads. This problem is not limited to printers and is common to liquid discharging apparatuses which are provided with a plurality of valves and a plurality of recording heads.

SUMMARY

The invention can be realized in the following aspects or application examples.

(1) According to an aspect of the invention, there is provided a liquid discharging apparatus. The liquid discharging apparatus includes a second recording head including a second nozzle for discharging a second liquid, a first flow path for supplying the first liquid to the first recording head, a second flow path for supplying the second liquid to the second recording head, a first valve provided in the first flow path and provided with a first valve body configured to open and close according to a pressure on the first recording head side, and a second valve provided in the second flow path and provided with a second valve body configured to open and close according to a pressure on the second recording head side. The first valve has an openability different from an openability of the second valve, and a difference between dischargeabilities of the first liquid from the first nozzle and dischargeabilities of the second liquid from the second nozzle is smaller than the difference in a case in which the second valve is connected to the first recording head via the first flow path and the first valve is connected to the second recording head via the second flow path. Incidentally, the openability is a characteristic in relation to ease of opening. And the dischargeabilities is discharging characteristics. According to the liquid discharging apparatus, it is possible to suppress the degree of density irregularities from expanding due to variation in the ease of opening the valves or variation in the characteristics of the recording heads.

(2) The dischargeabilities may be represented by at least one of a weight of a droplet, a speed of the droplet, a dot diameter formed on a recording medium, and a position of a dot formed on the recording medium. In this configuration, it is possible to easily confirm whether or not the degree of the density irregularities is expanded.

(3) According to another aspect of the invention, there is provided a liquid discharging apparatus. The liquid discharging apparatus includes a first recording head including a first nozzle for discharging a first liquid, a second recording head including a second nozzle for discharging a second liquid, a first flow path for supplying the first liquid to the first recording head, a second flow path for supplying the second liquid to the second recording head, a first valve provided in the first flow path and provided with a first valve body configured to open and close according to a pressure on the first recording head side, and a second valve provided in the second flow path and provided with a second valve body configured to open and close according to a pressure on the second recording head side. The first valve has an openability different from an openability of the second valve, and in a state in which discharging of the first liquid from the first recording head and the second liquid from the second recording head is stopped, a difference between a height from an opening portion of the first nozzle to an interface of the first liquid and a height from an opening portion of the second nozzle to an interface of the second liquid is smaller than the difference in a case in which the second valve is connected to the first recording head via the first flow path and the first valve is connected to the second recording head via the second flow path. According to the liquid discharging apparatus, it is possible to suppress the degree of density irregularities from expanding due to variation in the ease of opening the valves or variation in the characteristics of the recording heads.

(4) The first liquid and the second liquid may be liquids of the same type. In this configuration, it is possible to suppress the occurrence of density irregularities for the same type of liquid.

(5) The first and second valves may each be provided with a spring for setting the first valve body or the second valve body to a closed state, and the openabilities may be represented by a force applied from the spring to the first valve body or the second valve body. In this configuration, it is possible to suppress density irregularities which originate in differences in the spring force of the springs which are provided in the valves.

(6) The first valve and the second valve may each be provided with a pressure chamber connected to the first recording head or the second recording head, a portion of the pressure chamber may be defined by a film member, the film member is configured to move the first valve body or the second valve body open by flexing according to a pressure change inside the pressure chamber, and the openabilities may be represented by a repulsive force of the film member when the film member moves the first valve body or the second valve body. In this configuration, it is possible to suppress density irregularities which originate in differences in the repulsive force of the film members which partition the pressure chambers.

(7) The film member may be configured to push a shaft provided in the first valve body or a shaft provided in the second valve body when the film member moves the first valve body or the second valve body, and the openabilities may be represented by a length of the shaft. In this configuration, it is possible to suppress density irregularities which originate in differences in the length of the shafts which are provided in the valve bodies.

(8) The first valve and the second valve may each be provided with a valve seat, the first valve body and the second valve body may each be provided with a seal member configured to contact with the valve seat in a ring-shaped manner in a closed state, and the openabilities may be represented by a seal diameter of the seal member. In this configuration, it is possible to suppress density irregularities which originate in differences in the seal diameter of the seal members which are provided in the valve bodies.

(9) The openability of the first valve body may be easier than that of the second valve body, and a height from the opening portion of the first nozzle to the first valve may be lower than a height from the opening portion of the second nozzle to the second valve. In this configuration, it is possible to suppress density irregularities which originate in differences in the water head from the opening portions of the nozzles to the valve bodies.

(10) The openability of the first valve body may be easier than that of the second valve body, and a flow path inside the first recording head may have a greater pressure loss than a flow path inside the second recording head. In this configuration, it is possible to suppress density irregularities which originate in differences in the pressure loss of the flow paths which are provided inside the recording heads.

(11) The openability of the first valve body may be easier than that of the second valve body, and a discharge flow rate from the first recording head may be higher than a discharge flow rate from the second recording head. In this configuration, it is possible to suppress density irregularities which originate in differences in the discharge flow rates of the recording heads.

(12) According to still another aspect of the invention, there is provided a manufacturing method of a liquid discharging apparatus. The manufacturing method includes (A) preparing a plurality of recording heads including nozzles for discharging a liquid, a plurality of flow paths for supplying the liquid to each of the plurality of recording heads, and a plurality of valves which are each provided with a valve body configured to open and close according to a pressure on a downstream side, (B) specifying respectively openabilities of the plurality of valves, (C) determining the recording head to be connected to each of the valves from among the plurality of recording heads according to the openabilities of each of the valves and the characteristics of each of the recording heads, and (D) connecting the plurality of valves to the plurality of recording heads via the plurality of flow paths according to the determination. According to the liquid discharging apparatus which is manufactured using the manufacturing method, it is possible to suppress the degree of density irregularities from expanding due to variation in the ease of opening the valves or variation in the characteristics of the recording heads.

(13) In the manufacturing method, (B) may include inspecting the openabilities of each of the plurality of valves and recording results of the inspection. In this configuration, it is possible to suppress the degree of the density irregularities from expanding according to the actual characteristics of the valves.

(14) In the manufacturing method, (A) may include manufacturing the plurality of the valves in which the openabilities are different. In this configuration, it is possible to suppress the degree of the density irregularities from expanding by preparing, in advance, the plurality of valves which have different characteristics relating to the ease of opening the valves.

(15) According to still another aspect of the invention, there is provided a maintenance method of the above liquid discharging apparatuses. The method includes (A) specifying respectively the openabilities of the first and second valves and (B) modifying respectively characteristics of the first and second recording heads according to the openabilities of the first and second valves. According to maintenance method of the liquid discharging apparatus, it is possible to suppress the degree of density irregularities from expanding due to variation in the ease of opening the valves or variation in the characteristics of the recording heads.

(16) The first and second valves may each be provided with a spring for setting the first valve body or the second valve body to a closed state, and the openabilities may be represented by a force applied from the spring to the first valve body or the second valve body. In this configuration, it is possible to suppress density irregularities which originate in differences in the spring force of the spring members which are provided in the valves.

(17) The first valve and the second valve may each be provided with a pressure chamber connected to the first recording head or the second recording head, a portion of the pressure chamber may be defined by a film member, the film member is configured to move the first valve body or the second valve body open by flexing according to a pressure change inside the pressure chamber, and the openabilities may be represented by a repulsive force of the film member when the film member moves the first valve body or the second valve body. In this configuration, it is possible to suppress density irregularities which originate in differences in the repulsive force of the film members which partition the pressure chambers.

(18) The first valve and the second valve may each be provided with a valve seat, the first valve body and the second valve body may each be provided with a seal member configured to contact with the valve seat in a ring-shaped manner in a closed state, and the openabilities may be represented by a seal diameter of the seal member. In this configuration, it is possible to suppress density irregularities which originate in differences in the seal diameter of the seal members which are provided in the valve bodies.

(19) The openability of the first valve body may be easier than that of the second valve body, and a height from the opening portion of the first nozzle to the first valve may be lower than a height from the opening portion of the second nozzle to the second valve. In this configuration, it is possible to suppress density irregularities which originate in differences in the water head from the opening portions of the nozzles to the valve bodies.

(20) The openability of the first valve body may be easier than that of the second valve body, and a flow path inside the first recording head may have a greater pressure loss than a flow path inside the second recording head. In this configuration, it is possible to suppress density irregularities which originate in differences in the pressure loss of the flow paths which are provided inside the recording heads.

BRIEF DESCRIPTION OF THE DRAWINGS

The invention will be described with reference to the accompanying drawings, wherein like numbers reference like elements.

FIG. 10 is a table illustrating the combinations of the valves and the recording heads.

DESCRIPTION OF EXEMPLARY EMBODIMENTS

A. First Embodiment

Figure 1:
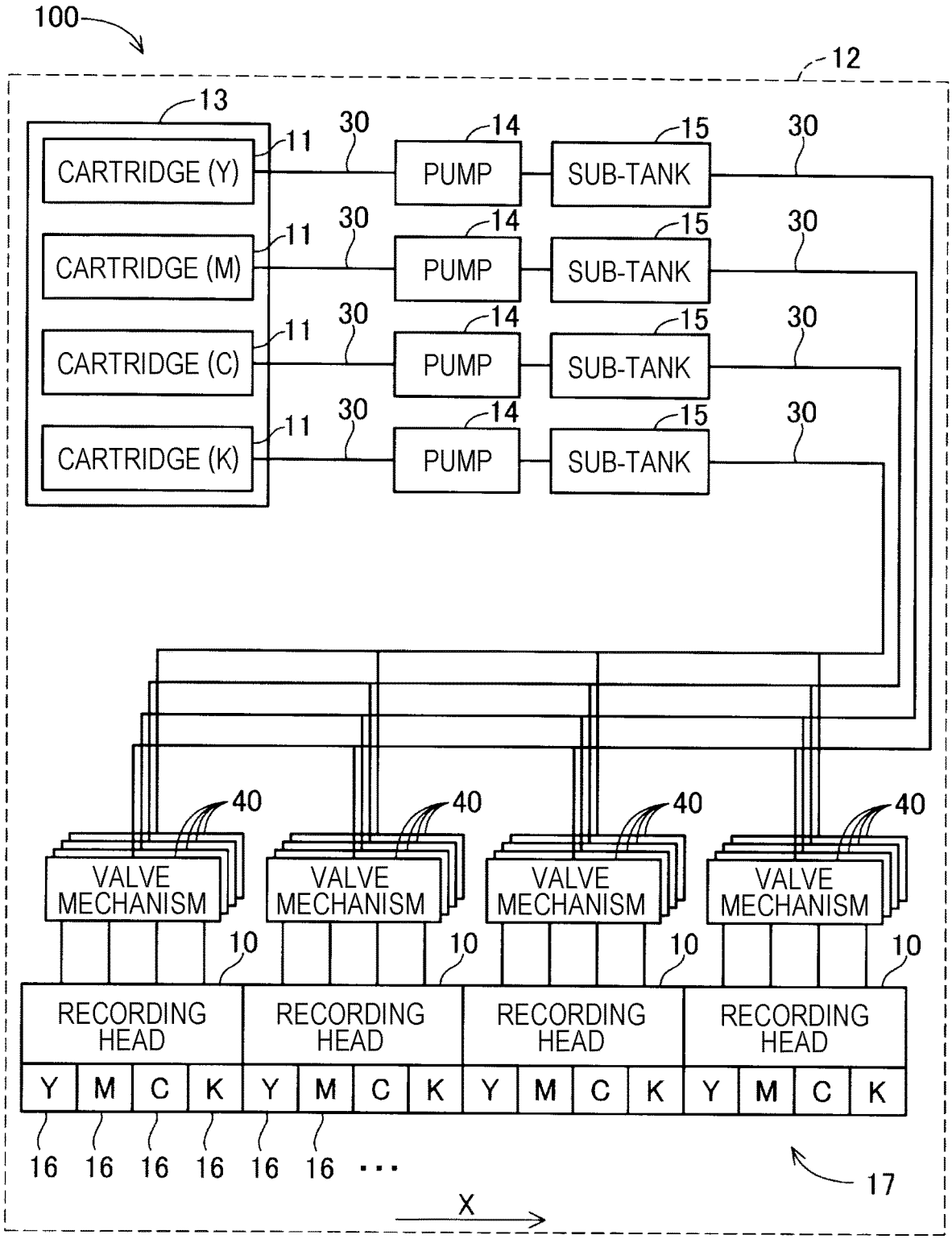
FIG. 1 is an explanatory diagram illustrating a schematic configuration of a liquid discharging apparatus.

FIG. 1 is an explanatory diagram illustrating a schematic configuration of a liquid discharging apparatus 100 in the first embodiment. The liquid discharging apparatus 100 is configured as an ink jet printer which is provided with a line head 17. The liquid discharging apparatus 100 is provided with a plurality of recording heads 10 which configure the line head 17, a plurality of flow paths 30, and a plurality of valves 40. An X direction illustrated in FIG. 1 is a direction in which the plurality of recording heads 10 lines up in the horizontal direction. The recording medium is transported in a direction which is perpendicular to the X direction in the horizontal direction by a transport mechanism (not illustrated). In addition to paper, examples of the recording medium include plastic, film, fiber, fabric, leather, metal, glass, wood, and ceramic, that is, anything capable of holding a liquid.

A plurality of cartridges 11 which store the liquid are mounted on the liquid discharging apparatus 100. A different type of ink is stored in each of the cartridges 11. The type of the ink refers to the color in the present embodiment. In the present embodiment, four colors of the cartridges 11 are mounted on the liquid discharging apparatus 100, one for each of yellow, magenta, cyan, and black. The colors of the ink are not limited to these four, and, for example, may additionally include light cyan and light magenta, totaling six colors. Five or more colors in which red, blue, green, white, special colors such as transparent are added may be used. Examples of the types of the ink additionally include, for example, the type of colorant contained (whether the colorant is a dye or a pigment) and whether the ink is chromatic or achromatic.

The cartridges 11 are mounted on a predetermined cartridge mounting portion 13 inside a housing 12 of the liquid discharging apparatus 100. The cartridge mounting portion 13 is provided at a fixed position instead of on the carriage. In other words, in the present embodiment, the liquid discharging apparatus 100 is an off-carriage type printer. The cartridge mounting portion 13 may be disposed on the outside of the housing 12.

Each of the cartridges 11 is connected to a corresponding flow path 30 for supplying the ink to the recording heads 10. One flow path 30 is provided for each of the cartridges 11.

A pump 14 is provided on the downstream side of the cartridge 11 of each of the flow paths 30. The pump 14 sucks the ink from the cartridge 11 through the flow path 30. The pump 14 may be configured by a diaphragm pump, for example.

A sub-tank 15 is provided closer to the downstream side than the pump 14 of each of the flow paths 30. The inks are supplied to the sub-tanks 15 from the pumps 14 through the flow paths 30 and are temporarily stored. A check valve for preventing the ink from flowing backward to the upstream side (the cartridge 11 side) may be provided between the sub-tank 15 and the pump 14 or between the pump 14 and the cartridge 11 of each of the flow paths 30.

The valve 40 is provided closer to the downstream side than the sub-tank 15 in each of the flow paths 30. Each of the valves 40 is provided with a valve body which opens and closes according to the pressure on the downstream side of the valve 40, that is, on the recording head 10 side with respect to the valve 40. In a case in which the pressure on the recording head 10 side is greater than or equal to a predetermined pressure, the valve on the inner portion of the valve 40 is closed to ensure that the ink is not supplied to the recording head 10 side, and in a case in which the pressure on the recording head 10 side falls below the predetermined pressure, the valve on the inner portion of the valve 40 opens and the ink which is supplied from the sub-tank 15 is supplied to the recording head 10 side. The valve 40 may also be referred to as "a self-sealing valve" or "a differential pressure valve". The valve 40 also serves the role of separating a negative pressure state inside the recording head 10 and a positive pressure state on the cartridge 11 side from each other such that a compressive force from the pump 14 does not act directly on the recording head 10 in the negative pressure state. A description will be given later of the detailed configuration of the valve 40.

The recording heads 10 are provided closer to the downstream side than the valves 40 in each of the flow paths 30. In other words, the valves 40 are connected to the corresponding recording heads 10 via the flow paths 30. A filter for trapping foreign matter may be provided between each of the valves 40 and the recording heads 10. The recording head 10 is provided with nozzles 16 which discharge the inks downward. When the inks are discharged from the nozzles 16, the flow paths inside the recording head 10 assume a negative pressure, the pressure is transmitted to the valves 40 on the upstream side, and the inks are supplied from the valves 40. In the present embodiment, each of the recording heads 10 is provided with yellow nozzle 16, a magenta nozzle 16, a cyan nozzle 16 and a black nozzle 16. Each color of ink is supplied to each color of nozzle 16 from the valves 40 which are prepared for each color. The recording head 10 in the present embodiment is a piezoelectric system head and is provided with a piezoelectric actuator for causing the ink to be ejected for each of the nozzles 16. The recording head 10 is not limited to using the piezoelectric system, and for example, may use a thermal system.

Figure 2:
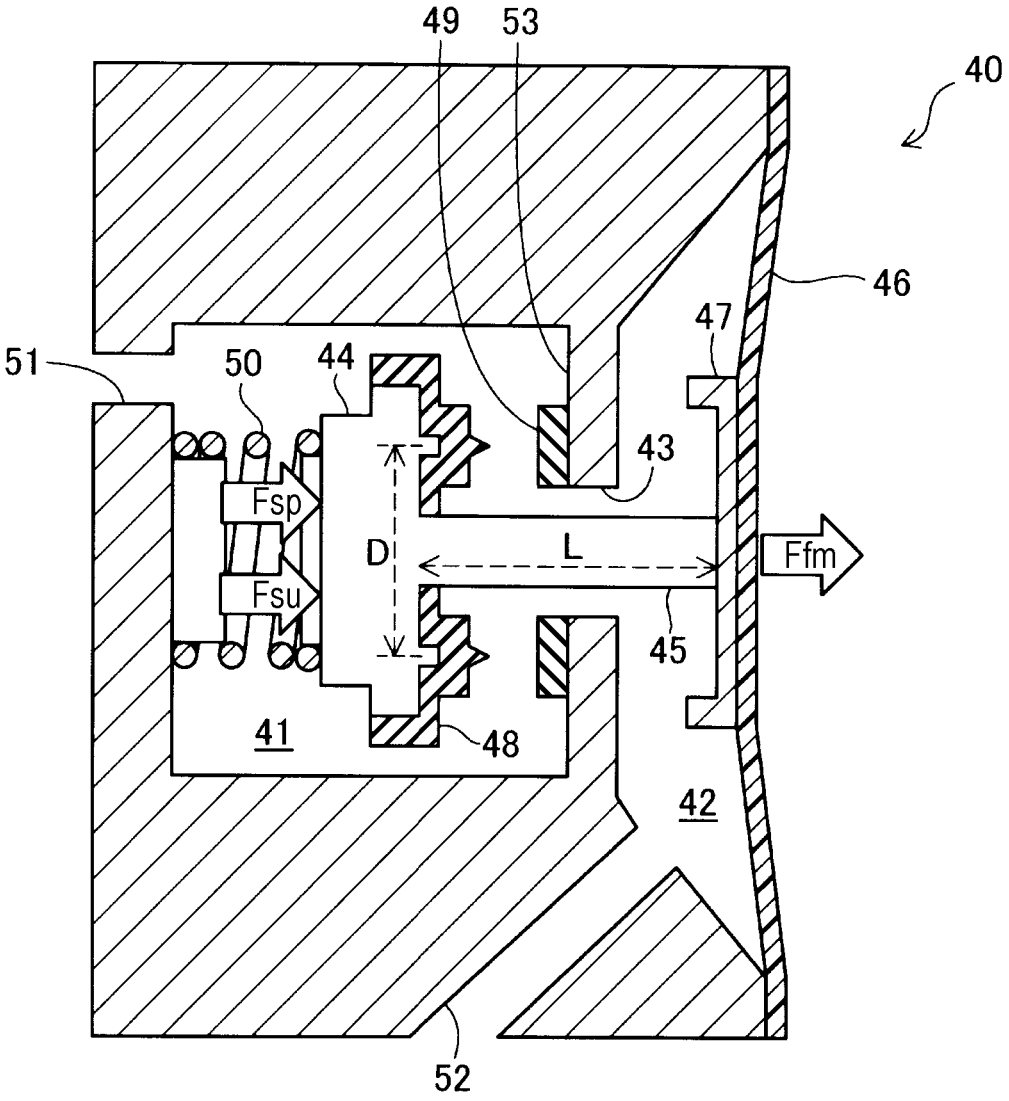
FIG. 2 is a sectional diagram illustrating a schematic configuration of a valve.

FIG. 2 is a sectional diagram illustrating a schematic configuration of the valve 40. FIG. 2 illustrates a state in which the ink is sucked from the recording head 10 and a valve body 44 on the inner portion of the valve 40 assumes an open state. The valve 40 is provided with a liquid supply chamber 41 which is connected to the sub-tank 15, and a pressure chamber 42 which is connected to the recording head 10. The liquid supply chamber 41 and the pressure chamber 42 are partitioned by a partitioning wall 53. The ink is supplied to the liquid supply chamber 41 from the sub-tank 15 through a supply port 51. The ink is output from the pressure chamber 42, through an output port 52, and to the recording head 10. A communicating hole 43 is formed in the partitioning wall 53. The inner space of the liquid supply chamber 41 and the inner space of the pressure chamber 42 are communicated by the communicating hole 43.

The substantially disc-shaped valve body 44 is disposed in the liquid supply chamber 41. The valve body 44 includes a columnar shaft 45 which protrudes to the pressure chamber 42 side. The shaft 45 passes through the inside of the communicating hole 43 and the distal end portion of the shaft 45 is positioned inside the pressure chamber 42. The distal end portion of the shaft 45 is capable of coming into contact with a film member 46, which forms a portion of the pressure chamber 42, via a pressure receiving plate 47.

The ink inside the liquid supply chamber 41 passes between the shaft 45 and the inner surface of the communicating hole 43 to flow into the pressure chamber 42. The surface of the valve body 44 that faces the pressure chamber 42 side is provided with an annular seal member 48 centered on the shaft 45. In the periphery of the communicating hole 43 of the partitioning wall 53, a valve seat 49 is provided on the surface of the partitioning wall 53 which faces the pressure chamber 42 side. The seal member 48 which is provided on the valve body 44 comes into contact with the valve seat 49 in a ring-shaped manner in a state in which the valve body 44 is closed. The flowing of the ink from the liquid supply chamber 41 to the pressure chamber 42 is blocked by the seal member 48 coming into contact with the valve seat 49. The valve seat 49 may not be an independent member, and the surface of the partitioning wall 53 which faces the valve body 44 side may function as the valve seat.

A spring member 50 is disposed between the surface of the valve body 44 on the opposite side from the pressure chamber 42 side and the housing of the valve 40. The spring member 50 is a member for setting the valve body 44 to the closed state and pushes the valve body 44 against the valve seat 49. In addition to the spring member 50, a spring member may also be disposed between the pressure receiving plate 47 and the partitioning wall 53 in the valve 40. A configuration may be adopted in which the spring member 50 is not disposed, for example, the valve 40 may be disposed such that the shaft 45 faces vertically downward and the seal member 48 and the valve seat 49 of the valve body 44 may be caused to come into contact with each other by the weight of the valve body 44 itself to block the flow of the ink.

The film member 46 has flexibility. In a case in which the pressure inside the pressure chamber 42 drops, the film member 46 moves the valve body 44 by flexing to set the valve body 44 to the open state. Specifically, when the pressure inside the pressure chamber 42 becomes a negative pressure which is lower than the atmospheric pressure, the film member 46 flexes in a direction which reduces the volume of the pressure chamber 42 (the left side of FIG. 2). Subsequently, the pressure receiving plate 47 which is provided on the film member 46 pushes the distal end portion of the shaft 45 to move the valve body 44 in a direction distancing from the valve seat 49. Therefore, the valve 40 is capable of controlling the flow of the ink from the sub-tank 15 to the recording head 10 without being driven by a another motive force due to the valve body 44 moving in the inner portion of the valve 40 according to the pressure inside the pressure chamber 42, that is, according to the pressure on the recording head 10 side.

Here, a pressure Pa which is assumed when the valve body 44 assumes the open state may be obtained using Expression (1) below, where the pressure of the ink inside the liquid supply chamber 41 is Psu, the force received by the valve body 44 on the pressure chamber 42 side from the ink inside the liquid supply chamber 41 is Fsu, the force received by the valve body 44 on the pressure chamber 42 side from the spring member 50 is Fsp, the force to restore the film member 46 from a flexed state to the original state (a repulsive force of the film member 46) is Ffm, a pressure receiving surface area of the valve body 44 which receives the pressure from the ink inside the liquid supply chamber 41 is Ssu ($=\pi\times(\text{seal diameter } D/2)^2$), and a pressure receiving surface area of the pressure chamber 42 is Sa. Hereinafter, the pressure Pa will be referred to as an operating pressure Pa. The pressure receiving surface area Sa is the surface area which receives the operating pressure Pa on the pressure receiving plate 47 and a portion of the film member 46. The ink is sucked from the pressure chamber 42 by the recording head 10, the pressure inside the pressure chamber 42 becomes a negative pressure, and when the pressure inside the pressure chamber 42 increases to the negative side more than the operating pressure Pa, the valve 40 assumes the open state and the ink flows from the sub-tank 15 side to the recording head 10 side. The operating pressure Pa is, for example, −1.5 kPa.

$$Pa=i(Fsp+Ffm+Fsu)/Sa \quad (1)$$

(where Fsu=Psu×Ssu)

Figures 3, 4:
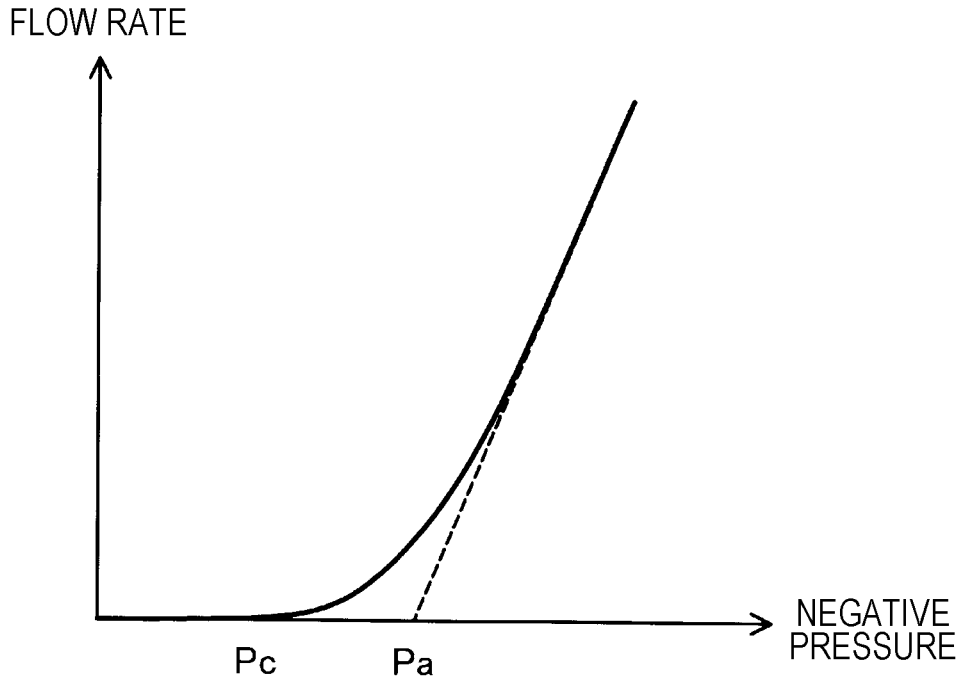
FIG. 3 is a graph representing an outline of operational characteristics of the valve.
FIG. 4 is an explanatory diagram illustrating the ease of opening the valve and fluctuation causes.

FIG. 3 is a graph representing an outline of operational characteristics of the valve 40. The valve 40 has similar characteristics to the forward characteristics of a diode in an electrical circuit. Specifically, as illustrated in FIG. 3, when the pressure inside the pressure chamber 42 exceeds a predetermined pressure in the negative direction, the flow rate of the ink which is supplied from the pressure chamber 42 increases nonlinearly due to variation in the separation distance between the valve body 44 and the valve seat 49 in the circumferential direction, and when the pressure inside the pressure chamber 42 further exceeds a certain pressure, the separation distance between the valve body 44 and the valve seat 49 becomes sufficient and the flow rate increases linearly. In this manner, the relationship between the pressure inside the pressure chamber 42 and the flow rate of the ink which flows out from the pressure chamber 42 is divided into a nonlinear region and a linear region. In the present embodiment, the operating pressure Pa which is defined by Expression (1) is the pressure Pa corresponding to the intersection point between the characteristic straight line in the linear region and the pressure axis. In the characteristic illustrated in FIG. 3, the pressure is increased from zero in the negative direction and a pressure Pc (also referred to as a holding pressure Pc) at which the flow rate in the nonlinear region becomes measurable (the ink begins to flow) may be treated as the operating pressure Pa.

The operating pressure Pa of the valve 40 represents the ease of opening the valve body 44 of the inner portion of the valve 40. Specifically, in a case in which the absolute value of the operating pressure Pa of the valve 40 is great, since the valve body 44 is not in the open state as long as the inside of the pressure chamber 42 is not set to a greatly negative pressure, the valve does not open easily. Conversely, in a case in which the absolute value of the operating pressure Pa is small, since the valve body 44 is not in the open state even if the pressure inside the pressure chamber 42 is not set to that greatly negative pressure, the valve opens easily. There is a case in which the operating pressure Pa is different for each of the valves 40 due to manufacturing error and the like. In other words, there is a case in which the ease of opening each of the valves 40 is different for each individual valve 40.

FIG. 4 is an explanatory diagram illustrating the ease of opening the valve 40 and fluctuation causes. As illustrated in FIG. 4, example of causes which determine the ease of opening the valves 40, in other words, examples of characteristics relating to the ease of opening the valves 40 include (i) a pushing force Fsp with which the spring member 50 pushes the valve body 44, (ii) a repulsive force Ffm of the film member 46, (iii) a length L of the shaft 45, and (iv) a seal diameter D of the seal member 48. If the pushing force Fsp with which the spring member 50 pushes the valve body 44 is great due to differences in a spring coefficient or the like, as may be ascertained from Expression (1), the operating pressure Pa increases on the negative side and the valve 40 opens less easily. If the repulsive force Ffm of the film member 46 is great due to differences in the thickness of the film member 46 or the like, as may be ascertained from Expression (1), the operating pressure Pa increases on the negative side and the valve 40 opens less easily. If the length L of the shaft 45 is short, since the pressure receiving plate 47 comes into contact with the shaft 45 less easily, the operating pressure Pa increases on the negative side and the valve 40 opens less easily. When the seal diameter D of the seal member 48 is large, since the force Fsu which the valve body 44 receives from the liquid supply chamber 41 side increases, as may be ascertained from Expression (1), the operating pressure Pa increases on the negative side and the valve 40 opens less easily. Additionally, for example, when the pressure receiving surface area Sa is small, as may be ascertained from Expression (1), the operating pressure Pa increases on the negative side and the valve 40 opens less easily. In a case in which the ease of opening the valve 40 is different for each individual valve 40 due to these causes, the differences cause variation in the ink supply amount to the recording heads 10 and there is a case in which this appears as density irregularities in the printed image. Even in a case in which the supply pressure of the ink to the liquid supply chamber 41 is great due to causes other than those described above, for example, due to differences in the water head from the valve 40 to the sub-tank 15 and the like, the operating pressure Pa increases on the negative side and the valve opens less easily.

Figure 5:
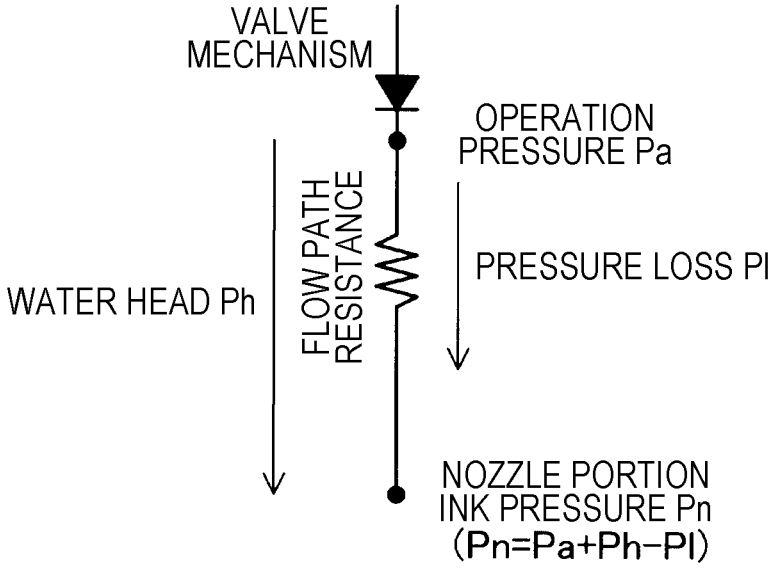
FIG. 5 is an explanatory diagram representing an equivalent circuit of the valve and the recording head.

FIG. 5 is an explanatory diagram representing an equivalent circuit of the valve 40 and the recording head 10. As described earlier, the valve 40 may be regarded as a diode on an electrical circuit. The flow path from the output port 52 of the valve 40 to the distal end of the nozzle 16 of the recording head 10 may be regarded as a resistor. Therefore, it is possible to represent the valve 40 and the recording head 10 as a circuit in which a diode is connected to a resistor in series in the forward direction. Here, a pressure Pn which applies to the ink which is present at the distal end of the nozzle 16 is represented by the following Expression (2), where the operating pressure of the valve 40 is Pa, the pressure loss due to flow path resistance inside the recording head 10 is Pl (=flow path resistance×flow rate), and the water head from the nozzle distal end of the recording head 10 to the valve 40 is Ph. Hereinafter, the pressure Pn will be referred to as a nozzle portion ink pressure Pn. The operating pressure Pa in Expression (2) is a differential pressure with the atmosphere and the nozzle portion ink pressure Pn is also a differential pressure with the atmospheric pressure.

$$Pn=Pa+Ph-Pl \tag{2}$$

In a case in which the nozzle portion ink pressure Pn deviates from a predetermined pressure range, there is a possibility that the ink may not be discharged as droplets due to the ink leaking from the nozzle 16, being pulled into the recording head 10, or the like. Specifically, when the nozzle portion ink pressure Pn increases to the negative side more than a predetermined negative pressure (for example, −4.5 kPa), there is a possibility that the ink of the nozzle distal end will be pulled into the recording head 10 and printing omissions will occur. When the nozzle portion ink pressure Pn increases to more than a predetermined positive pressure (for example, 1.0 kPa), there is a possibility that the meniscus of the ink inside the nozzle 16 will break and the ink will dribble from the nozzle distal end. Therefore, the operating pressure Pa, the pressure loss Pl, and the water head Ph of the valve 40 are adjusted such that the nozzle portion ink pressure Pn falls within a predetermined pressure range. However, even if the values are adjusted to keep the nozzle portion ink pressure Pn within the predetermined pressure range, the weight of the ink which is discharged fluctuates according to the pressure. For example, if the nozzle portion ink pressure Pn is small, the amount of the ink which is discharged decreases and a small dot is formed on the recording medium. Meanwhile, if the nozzle portion ink pressure Pn is great, the amount of the ink which is discharged increases and a large dot is formed on the recording medium. Therefore, there is a case in which the differences in the nozzle portion ink pressure Pn for each of the nozzle portion ink pressures 16 (for each of the recording heads 10) appears as density irregularities in the printed image.

Figure 6:
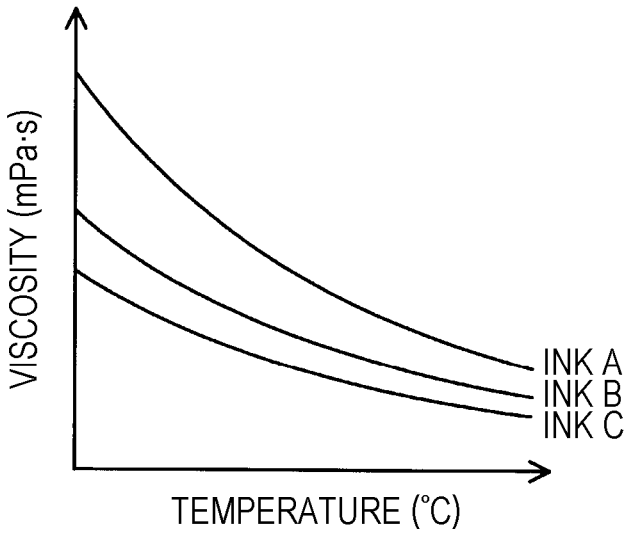
FIG. 6 is a graph illustrating a temperature dependence characteristic of viscosity of inks.

FIG. 6 is a graph illustrating a temperature dependence characteristic of viscosity of inks. FIG. 6 illustrates the characteristics of three types of ink. As illustrated in FIG. 6, the ink generally becomes lower in viscosity the higher the temperature. Here, the pressure loss illustrated in FIG. 5 is generally known to become greater the higher the viscosity of the ink. Therefore, in a case in which the temperature of the ink which flows inside the recording head 10 is influenced by the heat emission of the piezoelectric actuators or the like, the pressure loss Pl in Expression (2) fluctuates according to the influence. Therefore, the nozzle portion ink pressure Pn fluctuates according to the environmental temperature of the recording head 10 and there is a case in which density irregularities occur in accordance with the fluctuation.

Figure 7:
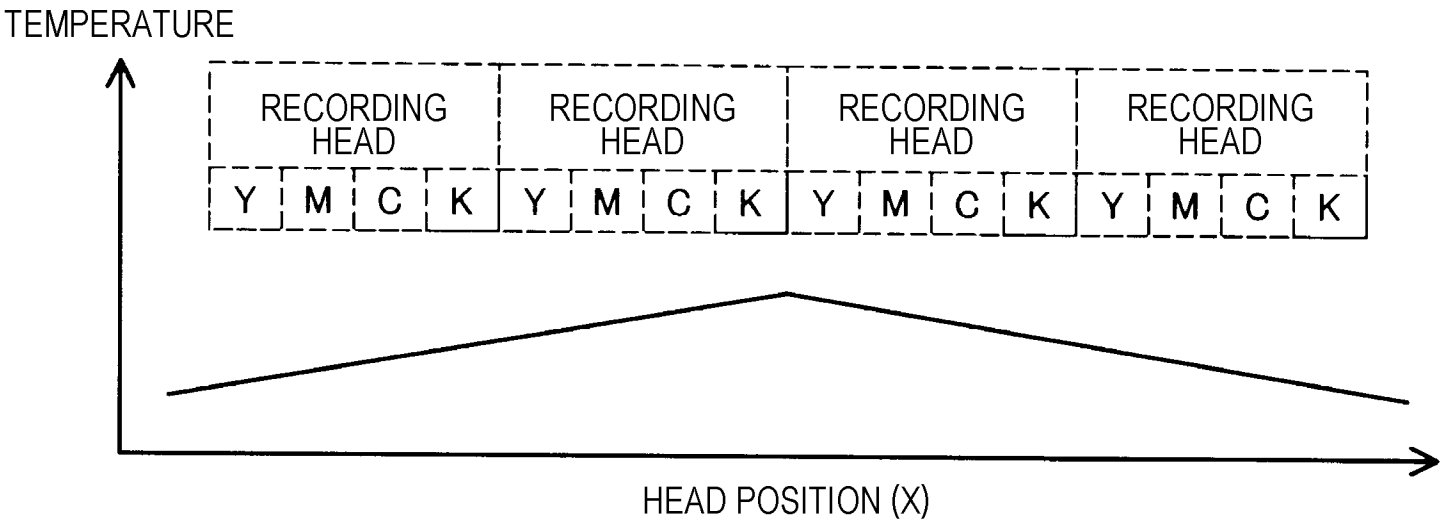
FIG. 7 is a graph conceptually illustrating an environmental temperature corresponding to positions of the recording heads.

FIG. 7 is a graph conceptually illustrating an environmental temperature corresponding to positions of the recording heads 10. The horizontal axis of the graph illustrated in FIG. 7 indicates the positions of the recording heads 10 in the line head 17 and the vertical axis indicates the environmental temperature corresponding to the positions of the recording heads 10. In a case in which the liquid discharging apparatus 100 is used, for example, there is a possibility that the heat emission of the piezoelectric actuators which are provided in each of the recording heads 10 is concentrated in the center portion inside the housing 12 and the temperature is higher the closer the recording head 10 is disposed to the center portion of the housing 12. In such a case, since the viscosity of the ink which flows in the inner portions of the recording heads 10 becomes lower and the pressure loss Pl becomes smaller in the recording heads 10 of the center portion as compared to the recording heads 10 which are disposed on the outside, the nozzle portion ink pressure Pn increases on the positive pressure side, as may be ascertained from Expression (2). Therefore, the ink is discharged more easily the closer the recording head 10 is displaced to the center portion and there is a possibility of density irregularities occurring. In particular, since the number of actuators to be driven at the same time is great in the line head 17, the heat emission amount is also great and temperature distribution occurs more easily. Additionally, the temperatures of the recording heads 10, for example, may increase the closer the recording head 10 is to a circuit board having a processor installed thereon or a power circuit.

Figure 8:
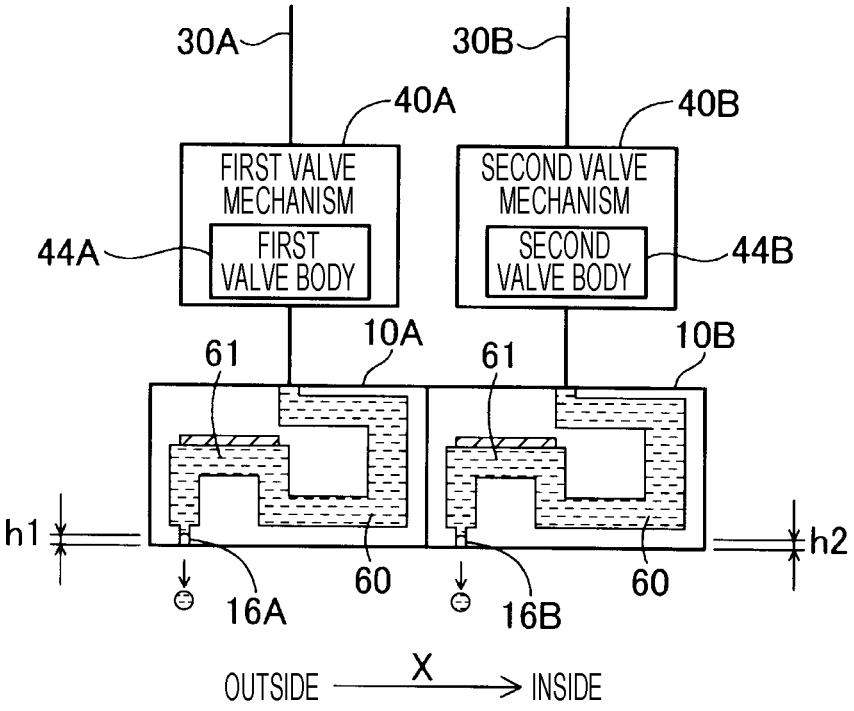
FIG. 8 is a diagram illustrating two recording heads.

FIG. 8 is a diagram illustrating two recording heads 10. FIG. 8 illustrates two recording heads 10, which are provided at different positions among the plurality of recording heads 10, as a first recording head 10A and a second recording head 10B. The first recording head 10A is provided with a first nozzle 16A which ejects the ink downward, and the second recording head 10B is provided with a second nozzle 16B which ejects the ink downward. The first recording head 10A and the second recording head 10B are provided with a storage chamber 60 and a pressurizing chamber 61 on the inner portions of the first recording head 10A and the second recording head 10B respectively. The ink which is supplied from the valve 40 is temporarily stored in the storage chamber 60 and the pressurizing chamber 61 is for applying a pressure to the ink. In the present embodiment, the nozzle 16 (the first nozzle 16A and the second nozzle 16B) refers to the flow path from the pressurizing chamber 61 to the opening portion which is provided in the bottom surface of the recording head 10.

In FIG. 8, the flow path 30 which supplies the ink to the first recording head 10A is illustrated as a first flow path 30A and the flow path 30 which supplies the ink to the second recording head 10B is illustrated as a second flow path 30B. The valve 40 which is provided in the first flow path 30A is illustrated as a first valve 40A and the valve 40 which is provided in the second flow path 30B is illustrated as a second valve 40B. The valve body 44 which is provided in the first valve 40A and opens and closes according to the pressure on the first recording head 10A side is illustrated as a first valve body 44A and the valve body 44 which is provided in the second valve 40B and opens and closes according to the pressure on the second recording head 10B side is illustrated as a second valve body 44B. To facilitate the explanation, FIG. 8 illustrates an example in which only one nozzle 16 is provided in each of the recording heads 10, and the explanation will be given assuming that the same type of (for example, black) ink is discharged from each of the nozzles 16A and 16B.

The first valve body 44A and the second valve body 44B illustrated in FIG. 8 have different characteristics with regard to the ease of opening. The first recording head 10A and the second recording head 10B are different due to the nozzle portion ink pressures Pn being different due to differences in the water head Ph in Expression (2). In the present embodiment, in a state in which the discharging of the ink from the first recording head 10A and the second recording head 10B is stopped, each of the recording heads 10 and each of the valves 40 are combined such that a difference (an absolute value) between a height h1 from the opening portion of the first nozzle 16A to the interface of the ink and a height h2 from the opening portion of the second nozzle 16B to the interface of the ink is smaller than the difference (the absolute value) of a case in which the second valve 40B is connected to the first recording head 10A via the first flow path 30A and the first valve 40A is connected to the second recording head 10B via the second flow path 30B.

Figure 9:
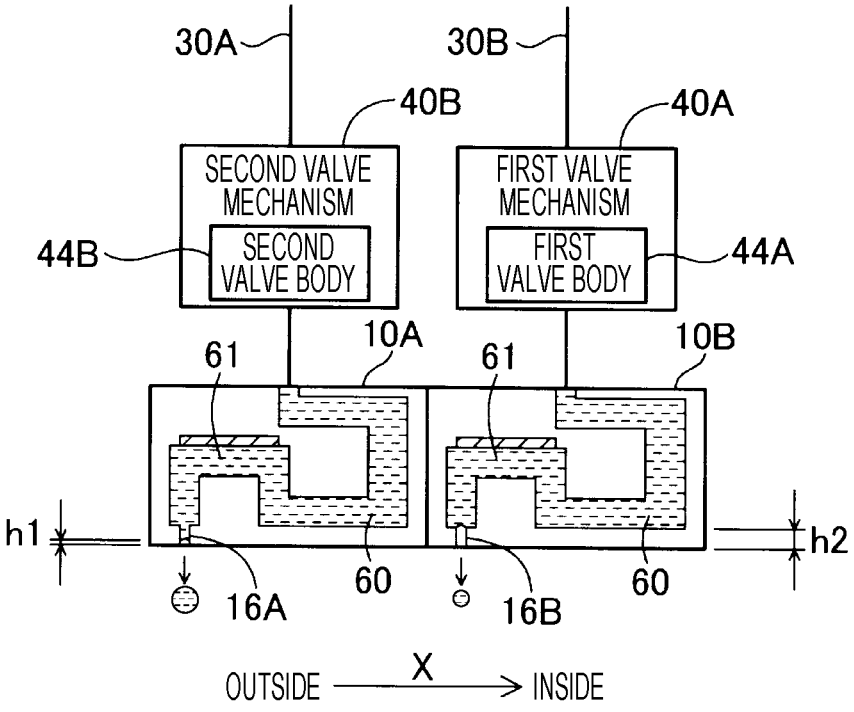
FIG. 9 is a diagram illustrating a situation in which a combination of the recording heads and the valves is switched around.

FIG. 9 is a diagram illustrating a situation in which a combination of the recording heads 10 and the valves 40 illustrated in FIG. 8 is switched around. In the combination of the recording heads 10 and the valves 40 illustrated in FIG. 8, the difference between the heights h1 and h2 of the interfaces of the inks is substantially 0 ($|h2-h1|=0$). However, as illustrated in FIG. 9, in a case in which the combination of the recording heads 10 and the valves 40 is reversed, in the present embodiment, the difference between the heights h1 and h2 of the interfaces of the inks increases ($|h2-h1|>0$). In other words, in the present embodiment, the combinations of each of the recording heads 10 and each of the valves 40 are determined such that the differences in the heights to the interfaces of the inks are reduced in each of the recording heads 10. Favorably combining each of the recording heads 10 and each of the valves 40 in this manner is referred to as "optimization" in the present embodiment. Since it is possible to suppress the occurrence of weight differences in the ink which is discharged during the ink discharging as long as each of the recording heads 10 and each of the valves 40 are combined such that the difference in the height to the interface of the ink is reduced in each of the recording heads 10, it is possible to suppress an expansion in the degree of the density irregularities caused by variation in the ease of opening of the valves 40 and variation in the characteristics of the recording heads 10.

In the present embodiment, not only in a state in which the discharging of the ink is stopped, but also in a state in which the ink is being discharged from the recording heads 10A and 10B, that is, a state in which the pressure loss Pl occurs inside the recording heads 10A and 10B, the differences in the discharging characteristics (for example, the dot diameter of the dots which are formed on the recording medium) between the first recording head 10A and the second recording head 10B increasing due to differences in the environmental temperature or the like illustrated in FIG. 7 is suppressed. Therefore, in the present embodiment, each of the recording heads 10 and each of the valves 40 are combined such that the difference between the discharging characteristics of the ink from the first nozzle 16A and the discharging characteristics of the ink from the second nozzle 16B in a case in which the first valve 40A is connected to the first recording head 10A via the first flow path 30A and the second valve 40B is connected to the second recording head 10B via the second flow path 30B is smaller than the difference between the discharging characteristics of the ink from the first nozzle 16A and the discharging characteristics of the ink from the second nozzle 16B in a case in which the second valve 40B is connected to the first recording head 10A via the first flow path 30A and the first valve 40A is connected to the second recording head 10B via the second flow path 30B. The discharging characteristic of the ink in the present embodiment is the dot diameter. Here, the dot diameter may be an average of a predetermined number of (for example, 10) dot diameters of the dots which are formed by discharging from the same nozzle. In this case, for example, in a state in which the distance between each of the nozzles 16A and 16B and the recording medium is the same, it is possible to compare the differences between the average value of the dot diameters of the dots which are formed by the first nozzle 16A and the average value of the dot diameters of the dots which are formed by the second nozzle 16B in different combinations of the valves 40 and the recording heads 10 and perform optimization by combining each of the recording heads 10 and each of the valves 40 such that the difference between the average values of the diameters is reduced.

FIG. 10 is a table illustrating the combinations of the valves 40 having different ease of opening and the recording heads 10 having different characteristics. In the present embodiment, the optimization is performed by combining and connecting the valve 40 which is easy to open with the recording head 10 which matches at least one of the following characteristics (C1) to (C8). In other words, by combining and connecting the valve 40 which is easy to open with the recording head 10 which matches at least one of the following characteristics (C1) to (C8), the difference in height from the nozzle opening portion to the ink interface increasing between the recording heads 10 is suppressed and the difference in the dot diameters of the dots which are formed on the recording medium increasing between the recording heads 10 is suppressed.

(C1) recording head having a small water head Ph
(C2) recording head having a great pressure loss Pl
(C3) recording head having high ink viscosity
(C4) recording head having low liquid temperature (environmental temperature)
(C5) recording head having long inner portion flow path length
(C6) recording head having small flow path sectional area
(C7) recording head having high (rough) inner portion flow path surface roughness
(C8) recording head having high discharge flow rate In the recording head 10 which satisfies the conditions of the characteristic (C1) and the characteristic (C2), the nozzle portion ink pressure Pn decreases as may be ascertained from Expression (2). Therefore, it is favorable to combine the recording head 10 with the valve 40 which operates at a small negative pressure and is easy to open. In the recording head 10 which satisfies the conditions of the characteristic (C3) to the characteristic (C8), since the pressure loss Pl increases in the same manner as the characteristic (C2), the nozzle portion ink pressure Pn decreases as may be ascertained from Expression (2). Therefore, it is favorable to combine the recording head 10 with the valve 40 which operates at a small negative pressure and is easy to open. Since the recording head 10 which satisfies the characteristic (C8) is used in the printing of a portion with a high ink duty, it is favorable to combine the recording head 10 with a valve which is easy to open. In a case of general printing, the discharge flow rate of the recording heads 10 which are provided in the center portion is higher than that of the recording heads 10 which are provided at the end portions.

Meanwhile, in the present embodiment, the optimization is performed by combining and connecting the valve which is not easy to open with the recording head 10 which matches at least one of the following characteristics (C9) to (C16). In other words, by combining and connecting the valve 40 which is not easy to open with the recording head 10 which matches at least one of the following characteristics (C9) to (C16), the difference in height from the nozzle opening portion to the ink interface increasing between the recording heads 10 is suppressed and the difference in the dot diameters of the dots which are formed on the recording medium increasing between the recording heads 10 is suppressed.

(C9) recording head having a large water head Ph
(C10) recording head having a small pressure loss Pl
(C11) recording head having low ink viscosity
(C12) recording head having high liquid temperature (environmental temperature)
(C13) recording head having short inner portion flow path length
(C14) recording head having large flow path sectional area
(C15) recording head having low (smooth) inner portion flow path surface roughness
(C16) recording head having low discharge flow rate In the recording head 10 which satisfies the conditions of the characteristic (C9) and the characteristic (C10), the nozzle portion ink pressure Pn increases as may be ascertained from Expression (2). Therefore, it is favorable to combine the recording head 10 with the valve 40 which operates at a large negative pressure and is not easy to open. In the recording head 10 which satisfies the conditions of the characteristic (C11) to the characteristic (C16), since the pressure loss Pl decreases in the same manner as the characteristic (C10), the nozzle portion ink pressure Pn increases as may be ascertained from Expression (2). Therefore, it is favorable to combine the recording head 10 with the valve 40 which operates at a large negative pressure and is not easy to open. In a case in which the characteristic (C16) is satisfied, since the use rate of the recording head 10 decreases, even if the recording head 10 is combined with the valve 40 which does not open easily, this has little influence on the image quality.

Figure 11:
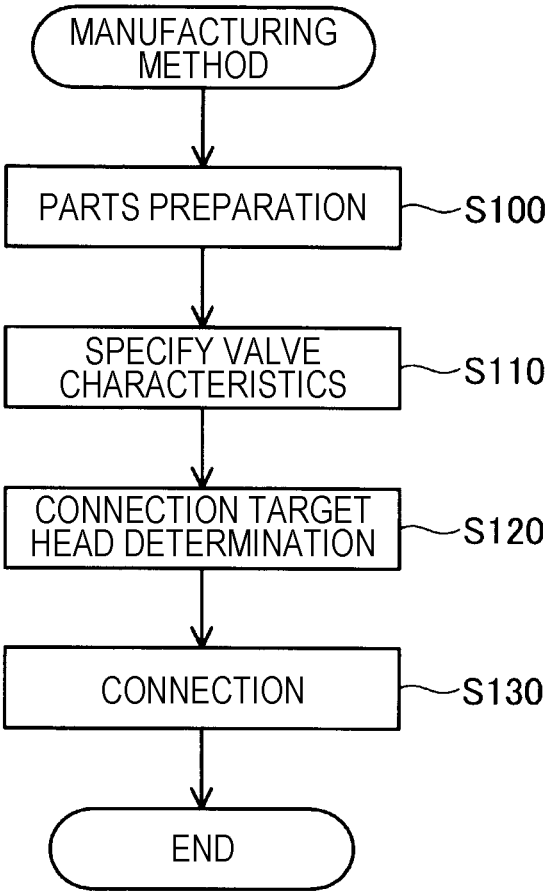
FIG. 11 is a process diagram illustrating a portion of a manufacturing method of the liquid discharging apparatus.

FIG. 11 is a process diagram illustrating a portion of a manufacturing method of the liquid discharging apparatus 100. First, the parts for assembling the liquid discharging apparatus 100 are prepared (step S100). The main parts are the plurality of recording heads 10 including the nozzles 16 which discharge the ink, the plurality of flow paths 30 for supplying the ink to the plurality of recording heads 10, respectively, and the plurality of valves 40 which are provided with the valve bodies 44 which open and close according to the pressure on the downstream side.

Next, with regard to the plurality of valves 40, the characteristics relating to the ease of opening the valves are specified for each (step S110). Specifically, for example, the characteristics of each of the valves 40 are specified by inspecting the characteristics of each of the plurality of valves 40 and storing the results in a memory device. In the present embodiment, for each of the valves 40 which are prepared in step S100, the operational characteristics illustrated in FIG. 3 are derived by obtaining the change in the discharge flow rate with respect to a negative pressure using tests, and the characteristics relating to the ease of opening the valve are specified for each of the plurality of valves 40 by obtaining the operating pressure Pa based on the operational characteristics. The characteristics relating to the ease of opening the valve may be specified as the value of the operating pressure Pa itself and may be specified by ranking the operating pressures Pa into a plurality of classifications.

After specifying the characteristics relating to the ease of opening the valve, the recording head 10 to use as the connection target of each of the valves 40 is determined from among the plurality of recording heads 10 according to the characteristics of the specified valve 40 and the characteristics of each of the recording heads 10 (step S120). If the characteristics of each of the recording heads 10 are already known, the combinations of the valves 40 and the recording heads 10 are determined based on the relationships illustrated in FIG. 10. For example, the determination is performed such that the valves 40 which are easy to open are connected to the recording heads 10 having a low environmental temperature in the line head 17. If the characteristics of the recording heads 10 are not already known, the characteristics of the recording heads 10 are obtained by inspection before step S120.

Finally, according to the determination in step S120, the plurality of valves 40 is connected to the plurality of recording heads 10 via the plurality of flow paths 30 (step S130). The liquid discharging apparatus 100 is manufactured after undergoing the series of processes which are described above.

In the present embodiment, in step S110, the characteristics relating to the ease of opening the valve are specified by performing an inspection on each of the valves 40. Alternatively, for example, in step S100, the plurality of valves 40 may be manufactured such that the characteristics relating to the ease of opening the valves are different. In this case, for example, by recording the characteristics in association with each of the valves 40 which are manufactured, it is possible to specify the characteristics relating to the ease of opening the valves for each of the plurality of valves 40 without performing the inspection of each of the valves 40 in step S110.

Figure 12:
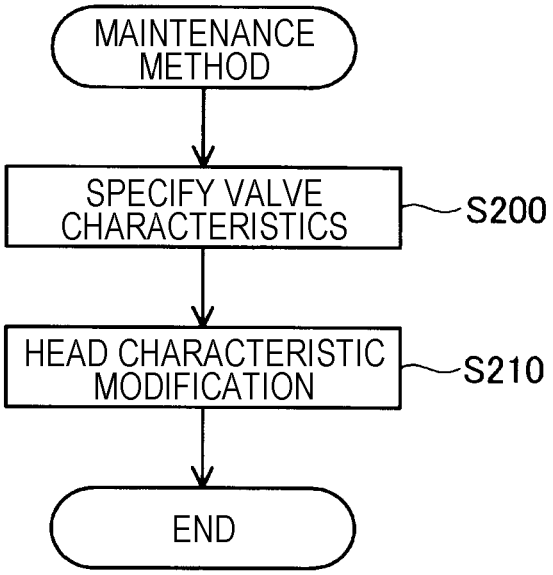
FIG. 12 is a process diagram illustrating a maintenance method of the liquid discharging apparatus.

FIG. 12 is a process diagram illustrating a maintenance method of the liquid discharging apparatus 100. The maintenance method is performed during the maintenance or the reparation of the liquid discharging apparatus 100 after manufacturing. First, the characteristics relating to the ease of opening of the plurality of valves 40 which are attached to the liquid discharging apparatus 100 are specified (step S200). The characteristic specification method is the same as the specification method in the manufacturing method described above (FIG. 11, step S110). However, for example, during the manufacturing of the liquid discharging apparatus 100, the characteristics of each of the valves 40 are stored in a memory which is provided in the liquid discharging apparatus 100 and the characteristics may be specified by reading the recording. The characteristics of each of the valves 40 which are specified during the manufacturing may be displayed in a visually recognizable manner on each of the valves 40 using labels, engraving, or the like, and the characteristics may be specified by referring to the display.

Next, the characteristics of each of the recording heads 10 which are connected to each of the valves 40 are modified according to the characteristics of each of the valves 40 which are specified in step S200 (step S210). Here, for example, it is possible to modify the water head Ph in Expression (2) by modifying the attachment height of each of the valves 40 to the recording heads 10 using spacers or the like. Therefore, based on the relationship illustrated in FIG. 10, it is possible to modify the characteristics of each of the recording heads 10 by adjusting the attachment heights of the valves 40 such that the water head Ph of the recording head 10 is decreased if the valve 40 is easy to open, and such that the water head Ph of the recording head 10 increases if the valve 40 is not easy to open. The liquid discharging apparatus 100 may be provided with a lifting and lowering device for lifting and lowering each of the valves 40 in order to adjust the attachment height of each of the valves 40. In step S210, the characteristics of the recording heads 10 which are the connection targets may be modified by removing the valves 40 or the recording heads 10 from the liquid discharging apparatus 100 and reconnecting the valves 40 or the recording heads 10 to obtain a better combination. For example, according to FIG. 10, it is possible to optimize the combinations of the valves 40 and the recording heads 10 by connecting the valves 40 that are easy to open to the recording heads 10 that have a lower temperature, and by connecting the valves 40 that are not easy to open to the recording heads 10 that have a higher temperature.

As illustrated in FIGS. 8 and 9, in the liquid discharging apparatus 100 of the present embodiment, each of the valves 40 is connected to each of the recording heads 10 such that the difference between the height from the opening portion of the first nozzle 16A to the interface of the ink and the height from the opening portion of the second nozzle 16B to the interface of the ink is reduced. Each of the valves 40 is connected to each of the recording heads 10 such that the difference between the dot diameter which is formed by the discharging of the ink from the first nozzle 16A and the dot diameter which is formed by the discharging of the ink from the second nozzle 16B is reduced. It is possible to suppress the degree of density irregularities from expanding due to variation in the ease of opening the valves 40 or variation in the characteristics of the recording heads 10 by connecting each of the valves 40 to each of the recording heads 10. Therefore, it is possible to improve the recording quality of the liquid discharging apparatus 100 onto the recording medium. In the present embodiment, instead of suppressing both the variation in the ease of opening the valves 40 and the variation in the characteristics of the recording heads 10, since the combinations of the valves 40 and the recording heads 10 are optimized such that the variations cancel each other out, it is possible to improve the recording quality at low cost.

According to the present embodiment, it is possible to suppress the density irregularities in the image which is recorded using the same type of ink by optimizing the valves 40 to be combined among the recording heads 10 which discharge the same type (for example, the same color) of ink. If the valves 40 to be combined are optimized among the recording heads 10 which eject different types of ink, it is possible to suppress the occurrence of differences in the image quality between different types of ink.

According to the present embodiment, as described using FIG. 4, it is possible to suppress density irregularities which originate in differences in the characteristics of the valves 40 such as differences in the spring force of the spring member 50 which is provided in the valve 40, differences in the repulsive force of the film member 46 which partitions the pressure chamber 42, differences in the length of the shaft 45 which is provided in the valve 40, and differences in the seal diameter of the seal member 48 which is provided in the valve 40. According to the present embodiment, as described using FIG. 10, it is possible to suppress density irregularities which originate in differences in the characteristics of the recording heads 10 such as differences in the water head from the opening portion of the nozzle 16 to the valve 40, differences in the pressure loss of the flow path inside the recording head 10, and differences in the discharge flow rate of the recording head 10.

B. Other Embodiments (B1) In the embodiment, a description is given of a case in which the combination of each of the valves 40 and each of the recording heads 10 is optimized such that the difference between the formed dot diameters is reduced. However, in addition to this configuration, for example, the optimization may be performed such that the differences in the discharging characteristics such as the weight of the droplet which is discharged, the speed of the droplet which is discharged, the width of the line which is formed on the recording medium, or the position of the dot which is formed on the recording medium. If the nozzle portion ink pressure Pn is different, the weight of the liquid which is discharged changes, leading to the dot diameter or the width of the line which is formed on the recording medium also changing. If the nozzle portion ink pressure Pn is different, the speed of the droplets (the movement speed from the nozzle to the recording medium) changes, and so the position of the dot which is formed on the recording medium changes according to the relative movement of the recording head 10 and the recording medium. Therefore, it is also possible to suppress an increase in the extent of the density irregularities due to the variation in the ease of opening the valve 40 and the variation in the characteristics of the recording head 10 by optimizing the combinations of the valves 40 and the recording heads 10 such that differences in the discharging characteristics are decreased. Since it is possible to easily measure or estimate the discharging characteristics from the printed result on the recording medium, it is possible to easily confirm whether or not the degree of density irregularities is expanded in the optimization process.

(B2) In the liquid discharging apparatus 100 illustrated in FIG. 1, it is also possible to omit the pumps 14 and the sub-tanks 15. For example, it is possible to omit the pumps 14 and the sub-tanks 15 by disposing the cartridges 11 and the valves 40 such that the differential head between the cartridges 11 and the valves 40 is sufficient.

(B3) In the embodiment, the recording quality is improved by adopting an optimized combination of the valves 40 and the recording heads 10. Alternatively, for example, the invention is similarly applicable to the combination of check valves, the operating pressures of which are varied, and the recording heads 10. The check valves, for example, are provided between the cartridges 11 and the pumps 14, between the pumps 14 and the sub-tanks 15, and between the sub-tanks 15 and the valves 40.

(B4) In the embodiment, for example, in a case in which a flexible pack is stored inside the cartridge 11 and the inside of the pack is filled with the ink, a pump for pressurizing the pack to push out the ink may be provided instead of the pump 14 illustrated in FIG. 1.

(B5) The invention is not limited to the liquid discharging apparatus which discharges the ink and it is also possible to apply the invention to an arbitrary liquid discharging apparatus which discharges a different liquid other than ink. For example, it is possible to apply the invention to various liquid discharging apparatuses such as those described below.

(1) An image recording apparatus such as a facsimile device.

(2) A color material discharging device which is used in the manufacture of color filters for image display devices such as liquid crystal displays.

(3) An electrode material discharging device which is used in the electrode formation of organic electro luminescence (EL) displays, field emission displays (FED), and the like.

(4) A liquid discharging apparatus which discharges a liquid containing bio-organic matter which is used in bio-chip manufacture.

(5) A sample discharging device which serves as a precision pipette.

(6) A discharge device of a lubricant.

(7) A discharge device of a resin liquid.

(8) A liquid discharging apparatus which discharges a lubricant onto precision machinery such as clocks and cameras at pinpoint precision.

(9) A liquid discharging apparatus which discharges a transparent resin liquid such as an ultraviolet curing resin liquid onto a substrate in order to form a hemispherical lens (an optical lens) to be used in an optical communication element or the like.

(10) A liquid discharging apparatus which discharges an acid or an alkaline etching liquid for etching a substrate or the like.

(11) A liquid discharging apparatus which is provided with a liquid discharging head which discharges a minute amount of another arbitrary liquid.

The term "droplets" refers to a state of the liquid which is discharged from the liquid discharging apparatus and includes liquids which form tails of a droplet shape, a tear shape, and a line shape. The "liquid" referred to here may be a material which the liquid discharging apparatus is capable of discharging. For example, the "liquid" may be a material which is in a liquid phase state, and includes high or low viscosity liquid state materials and liquid state materials such as sol, gel water, other inorganic solvents, organic solvents, solutions, liquid resins, and liquid metals (molten metals). The "liquid" not only includes liquids as a state of a material, but also includes solutions, disperses and mixtures in which particles of functional material formed from solids such as pigments and metal particulate are dissolved, dispersed or mixed into a solvent. Representative examples of the liquid include inks and liquid crystals. Here, the term "ink" includes general aqueous inks and solvent inks, as well as various liquid compositions such as gel ink and hot melt ink.

The invention is not limited to the embodiments and it is possible to realize the invention with various configurations within a scope that does not depart from the gist of the invention. For example, in order to solve a portion of or all of the problems, or alternatively, in order to achieve a portion of or all of the effects, it is possible to replace or combine, as appropriate, the technical features in embodiments corresponding to technical features in each embodiment described in the summary heading. As long as a technical feature is not described as required in the specification, it is possible to remove the technical feature, as appropriate.

The entire disclosure of Japanese Patent Application No. 2017-197395, filed Oct. 11, 2017 is expressly incorporated by reference herein.

What is claimed is:

1. A liquid discharging apparatus comprising:

a first recording head including a first nozzle for discharging a first liquid;

a second recording head including a second nozzle for discharging a second liquid;

a first flow path for supplying the first liquid to the first recording head;

a second flow path for supplying the second liquid to the second recording head;

a first valve provided in the first flow path and provided with a first valve body configured to open and close according to a pressure on the first recording head side; and a second valve provided in the second flow path and provided with a second valve body configured to open and close according to a pressure on the second recording head side, wherein:

the first valve has an openability different from an openability of the second valve, and when the first valve is connected to the first recording head via the first flow path, and the second valve is connected to the second recording head via the second flow path, a first difference between a dischargeability of the first liquid from the first nozzle and a dischargeability of the second liquid from the second nozzle is determined, when the second valve is connected to the first recording head via the first flow path and the first valve is connected to the second recording head via the second flow path, a second difference between the dischargeability of the first liquid from the first nozzle and the dischargeability of the second liquid from the second nozzle is determined, and the first difference is smaller than the second difference.

2. The liquid discharging apparatus according to claim 1, wherein the dischargeabilities are represented by at least one of a weight of a droplet, a speed of the droplet, a dot diameter formed on a recording medium, and a position of a dot formed on the recording medium.

3. The liquid discharging apparatus according to claim 1, wherein the first liquid and the second liquid are liquids of the same type.

4. The liquid discharging apparatus according to claim 1, wherein the first and second valves are each provided with a spring for setting the first valve body or the second valve body to a closed state, and wherein the openabilities are represented by a force applied from the spring to the first valve body or the second valve body.

5. The liquid discharging apparatus according to claim 1, wherein the first valve and the second valve are each provided with a pressure chamber connected to the first recording head or the second recording head, wherein a portion of the pressure chamber is defined by a film member, wherein the film member is configured to move the first valve body or the second valve body open by flexing according to a pressure change inside the pressure chamber, and wherein the openabilities are represented by a repulsive force of the film member when the film member moves the first valve body or the second valve body.

6. The liquid discharging apparatus according to claim 5, wherein the film member is configured to push a shaft provided in the first valve body or a shaft provided in the second valve body when the film member moves the first valve body or the second valve body, and wherein the openabilities are represented by a length of the shaft.

7. The liquid discharging apparatus according to claim 1, wherein the first valve and the second valve are each provided with a valve seat, wherein the first valve body and the second valve body are each provided with a seal member configured to contact with the valve seat in a ring-shaped manner in a closed state, and wherein the openabilities are represented by a seal diameter of the seal member.

8. The liquid discharging apparatus according to claim 1, wherein the openability of the first valve body is easier than that of the second valve body, and wherein a height from the opening portion of the first nozzle to the first valve is lower than a height from the opening portion of the second nozzle to the second valve.

9. The liquid discharging apparatus according to claim 1, wherein the openability of the first valve body is easier than that of the second valve body, and wherein a flow path inside the first recording head has a greater pressure loss than a flow path inside the second recording head.

10. The liquid discharging apparatus according to claim 1, wherein the openability of the first valve body is easier than that of the second valve body, and wherein a discharge flow rate from the first recording head is higher than a discharge flow rate from the second recording head.

* * * * *